US009689102B2

(12) United States Patent
Choi et al.

(10) Patent No.: US 9,689,102 B2
(45) Date of Patent: Jun. 27, 2017

(54) WASHING MACHINE FOR SENSING TILT OR VIBRATION TO THE CASING

(71) Applicant: LG ELECTRONICS INC., Seoul (KR)

(72) Inventors: San Choi, Changwon-si (KR); Kichul Cho, Changwon-si (KR); Jongchul Bang, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 394 days.

(21) Appl. No.: 14/551,443

(22) Filed: Nov. 24, 2014

(65) Prior Publication Data

US 2015/0176178 A1 Jun. 25, 2015

(30) Foreign Application Priority Data

Nov. 25, 2013 (KR) ..... 10-2013-0144033

(51) Int. Cl.

| | |
|---|---|
| ***D06F 37/20*** | (2006.01) |
| ***D06F 33/02*** | (2006.01) |
| ***D06F 37/30*** | (2006.01) |

(52) U.S. Cl.

CPC ..... *D06F 37/203* (2013.01); *D06F 33/02* (2013.01); *D06F 37/30* (2013.01); *D06F 2202/04* (2013.01); *D06F 2202/085* (2013.01); *D06F 2204/06* (2013.01)

(58) Field of Classification Search

None

See application file for complete search history.

(56) References Cited

U.S. PATENT DOCUMENTS

| | | | |
|---|---|---|---|
| 3,333,073 | A | 7/1967 | Ohlson |
| 3,583,182 | A | 6/1971 | Matsuura |
| 5,850,746 | A | 12/1998 | Lee |

FOREIGN PATENT DOCUMENTS

| | | | |
|---|---|---|---|
| CN | 1160100 | A | 9/1997 |
| GB | 2212013 | A | 7/1989 |
| JP | 2001-062189 | A | 3/2001 |
| KR | 20-1996-0022788 | U | 7/1996 |
| KR | 10-0137740 | B1 | 6/1998 |
| KR | 10-0179255 | B1 | 5/1999 |

*Primary Examiner* — Michael Barr
*Assistant Examiner* — Rita Adhlakha
(74) *Attorney, Agent, or Firm* — Dentons US LLP

(57) ABSTRACT

A washing machine is disclosed. The washing machine includes a casing, and a state sensing unit for sensing tilt of a predetermined angle or more of the casing or vibration of a predetermined magnitude or more applied to the casing. The state sensing unit includes a switching conductive element configured to move according to the tilt or the vibration, a contact electrode, and a guide electrode configured to guide movement of the switching conductive element and to be electrically connected to the contact electrode through the switching conductive element when the switching conductive element contacts the contact electrode.

12 Claims, 6 Drawing Sheets

WASHING MACHINE FOR SENSING TILT OR VIBRATION TO THE CASING

This application claims priority under 35 U.S.C. §119 to Korean Application No. 10-2013-0144033, filed Nov. 25, 2013, the subject matter of which is hereby incorporated by reference as if fully set forth herein.

TECHNICAL FIELD

The present invention relates to a washing machine.

BACKGROUND ART

In general, a washing machine includes a casing, a water tank disposed in the casing to store wash water therein, a wash tub rotatably mounted in the water tank to store laundry therein, and a driving unit for rotating the wash tub.

A washing machine should be balanced to prevent vibration when a wash tub rotates in washing, rinsing, dehydration and drying processes. When the washing machine is driven in an imbalanced state, for example, a state in which the washing machine is tilted by external force, the casing is tilted by improper installation, or strong vibration arises due to an imbalanced laundry load, operation of the washing machine needs to be stopped to prevent damage to devices and ensure safety. Therefore, there is a need to devise a way to accurately sense operation in an imbalanced state.

DISCLOSURE

Technical Problem

It is an object of the present invention to provide a washing machine capable of sensing operation in an imbalanced state due to tilt or vibration of a casing.

Technical Solution

In accordance with an aspect of the present invention, the above and other objects can be accomplished by the provision of a washing machine comprising: a casing; and a state sensing unit for sensing tilt of a predetermined angle or more of the casing or vibration of a predetermined magnitude or more applied to the casing, wherein the state sensing unit includes: a switching conductive element configured to move according to the tilt or the vibration; a contact electrode; and a guide electrode configured to guide movement of the switching conductive element and to be electrically connected to the contact electrode through the switching conductive element when the switching conductive element contacts the contact electrode.

Effects of the Invention

According to the washing machine of the present invention, since an abnormal state such as tilt or excessive vibration of the washing machine is sensed, damage to the product and accidents can be prevented.

Further, the washing machine of the present invention can sense tilt or excessive vibration more accurately through a sensing device embodied by integrated micro elements based on micro electro mechanical system (MEMS) technology.

DETAILED DESCRIPTION FOR IMPLEMENTING THE INVENTION

The objects, features and other advantages of the present invention will be more clearly understood from the following detailed description taken in conjunction with the accompanying drawings. However, the present invention is not limited to the following embodiments and may be embodied in different ways. Rather, the following embodiments are given by way of illustration only to provide thorough understanding of the invention to those skilled in the art. It should be understood that the scope of the invention should be limited only by the claims and equivalents thereof. The same reference numbers will be used throughout the specification and drawings to refer to the same or like parts.

Figure 1:
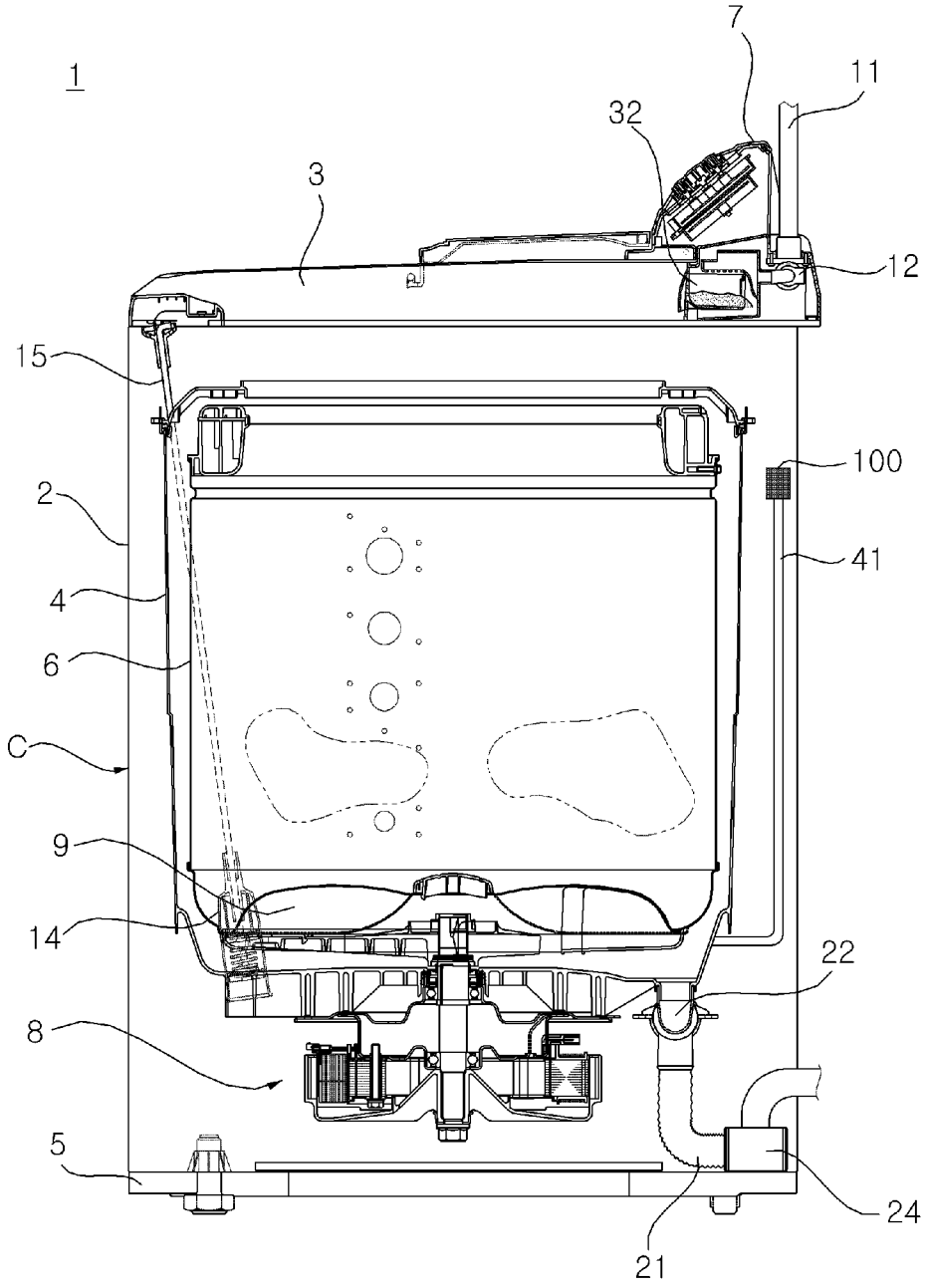
FIG. 1 is a sectional view illustrating a washing machine according to an embodiment of the present invention.
Figure 2:
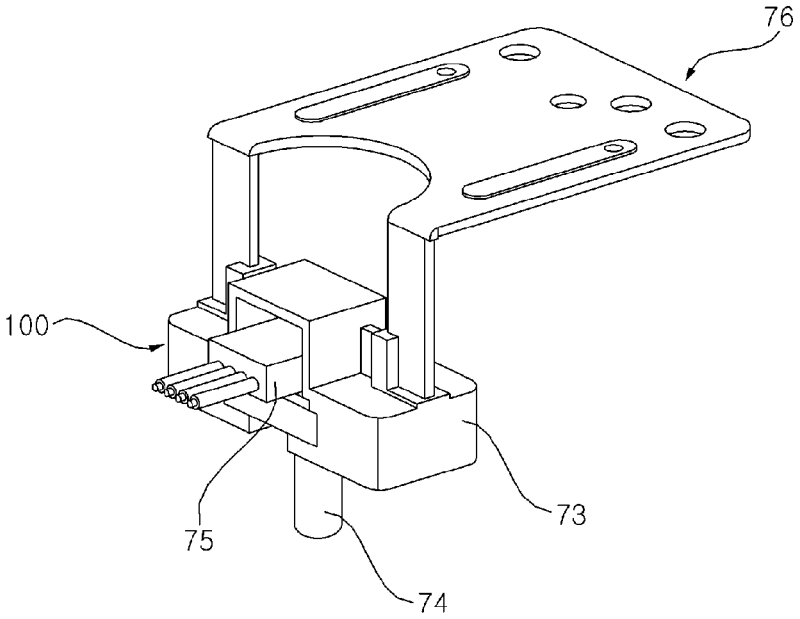
FIG. 2 is a view illustrating a water level sensing unit.
Figure 3:
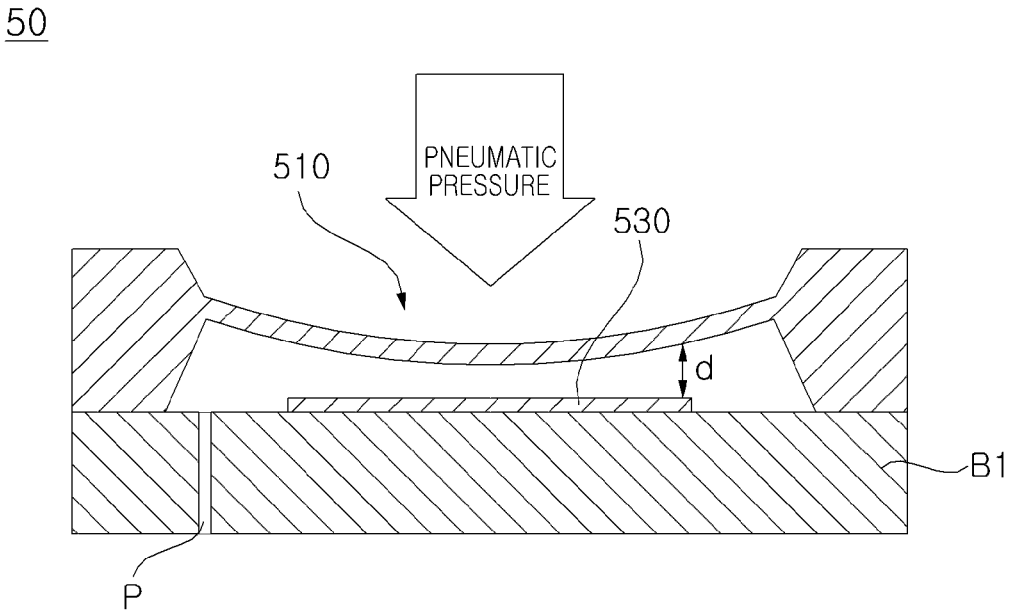
FIG. 3 is a view for explaining operation of a water level sensing unit.
Figure 4:
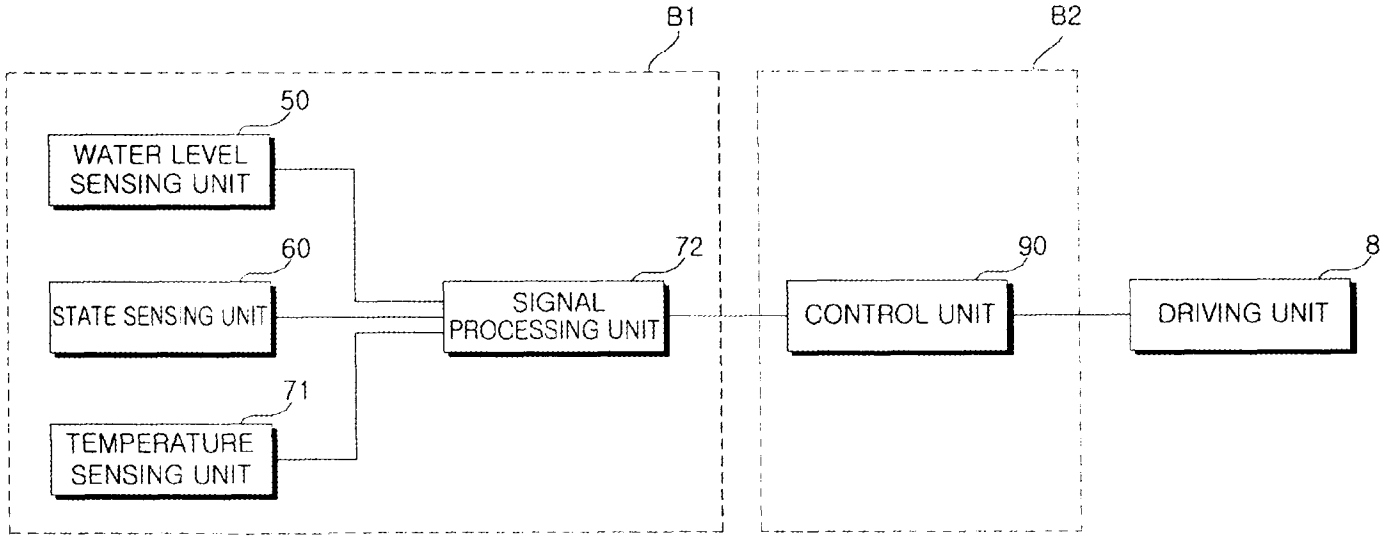
FIG. 4 is a block diagram illustrating a control relationship of a washing machine according to an embodiment of the present invention.

FIG. 1 is a sectional view illustrating a washing machine according to an embodiment of the present invention. FIG. 2 is a view illustrating a water level sensing unit. FIG. 3 is a view for explaining operation of a water level sensing unit. FIG. 4 is a block diagram illustrating a control relationship of a washing machine according to an embodiment of the present invention.

Referring to FIGS. 1 through 4, a washing machine 1 may comprise a casing C, a water tank 4 disposed in the casing C to store wash water therein, a wash tub 6 rotatably mounted in the water tank 4 to store laundry therein, and a driving unit 8 for rotating the wash tub 6.

The casing C serves to provide a space for containing components, such as the water tank 4, the wash tub 6, the driving unit 8, etc., constituting the washing machine 1. The casing C may include a cabinet 2 having an opened top portion, a base 5 for supporting the cabinet 2, and a top cover 3 coupled to the top portion of the cabinet 2 and having an entrance formed at a substantially center portion thereof to place laundry in the cabinet 2, however, the casing C is not limited to the above structure.

The top cover 3 may be provided with a door for opening and closing the entrance. The top cover 3 may be further provided with a control panel 7 for displaying an operating state of the washing machine 1 and providing an interface for receiving control commands for operating the washing machine 1 from a user.

The water tank 4 is suspended in the casing C. One end of a support rod 15 may be pivotably connected to the top cover 3, and the other end of the support rod 15 may be connected to a bottom of the water tank 4 by a suspension 14. Vibration of the water tank 4 is absorbed in the suspension 14.

A pulsator 9 may be rotatably mounted to a bottom of the wash tub 6. The pulsator 9 is configured to be rotated by the driving unit 8. According to selective operation of a clutch (not shown), only the pulsator 9 may be rotated, or both the pulsator 9 and the wash tub 6 may be rotated together. The wash tub 6 is formed with a plurality of holes (not shown) through which wash water circulates the wash tub 6 and the water tank 4.

The washing machine 1 may include a water supply passage 11 connected to an external water source, such as a faucet, etc., to supply water to the water tank 4 and/or the wash tub 6, and a water supply valve 12 for controlling the flow of water through the water supply passage 11. When the water supply valve 12 is opened, the wash water flowing through the water supply passage 11 may be supplied to the water tank 4 via a detergent container 32.

The washing machine 1 may further include a drainage passage 21 for discharging the wash water from the water tank 4, a drainage valve 22 for controlling the flow of wash water through the drainage passage 21, and a drainage pump 24 for pumping the wash water discharged through the drainage passage 21 to the outside of the washing machine 1.

One end of a pressure transmitting pipe 41 communicates with the water tank 4, and the other end of the pressure transmitting pipe 41 communicates with a sensing device 100. A pneumatic pressure in the pressure transmitting pipe 41 varies according to change of a water level of the water tank 4. The change of the pneumatic pressure is transmitted to the sensing device 100.

The sensing device 100 may include a water level sensing unit 50 configured to sense a water level based on the change of the pneumatic pressure transmitted through the pressure transmitting pipe 41. The sensing device 100 may include a housing 73 forming a space for accommodating the water level sensing unit 50 therein, and a connection pipe 74 connected to the pressure transmitting pipe 41 to allow the interior of the housing 73 to communicate with the pressure transmitting pipe 41. The sensing device 100 may further include a state sensing unit 60 and a temperature sensing unit 71 which will be described later. Preferably, the water level sensing unit 50, the state sensing unit 60 and the temperature sensing unit 71 may be embodied based on the micro electro mechanical system (MEMS) technology, and may be constructed in such a way that micro elements, such as a sensor, an actuator, a converter, an integrated circuit (IC), a memory cell, etc., are integrated on a common circuit board.

The sensing device 100 may include a terminal unit 75 electrically connected to a first circuit board B1 to which the water level sensing unit 50 is mounted, in order to allow power supply and/or signal input and output. There may be provided a bracket 76 for securing the sensing device 100 in the casing C.

The water level sensing unit 50 may include an electromagnetic diaphragm 510 configured to be deformed by the pneumatic pressure transmitted through the pressure transmitting pipe 41, and a conductive plate 530 disposed a predetermined distance from the diaphragm 510. The diaphragm 510 and the conductive plate 530 may be mounted to the first circuit board B1.

The diaphragm 510 may be made of a deformable material, and may have a coating layer made of a conductive material and coated on a surface opposing the conductive plate 530. Alternatively, the diaphragm 510 may be made of a material having both flexibility and conductivity, such as silicon or the like. Hereinafter, the diaphragm 510 made of a silicon material will be described.

By deformation of the diaphragm 510 due to the pneumatic pressure transmitted through the pressure transmitting pipe 41, a gap d between the diaphragm 510 and the conductive plate 530 is changed. Accordingly, a capacitance between the diaphragm 510 and the conductive plate 530 is changed. The pneumatic pressure transmitted through the pressure transmitting pipe 41 may vary according to change of the water level in the water tank 4 due to water supply or drainage, and may also vary according to the flow of wash water by rotation of the wash tub 6 or the pulsator 9. In the latter case, the water level sensing unit 50 may also be used as a sort of vibration sensor.

The first circuit board B1 may be formed with a communication hole P through which a space between the diaphragm 510 and the first circuit board B1 communicates with the external air. In this case, the space may be maintained at a constant pressure in spite of deformation of the diaphragm 510.

Figure 5:
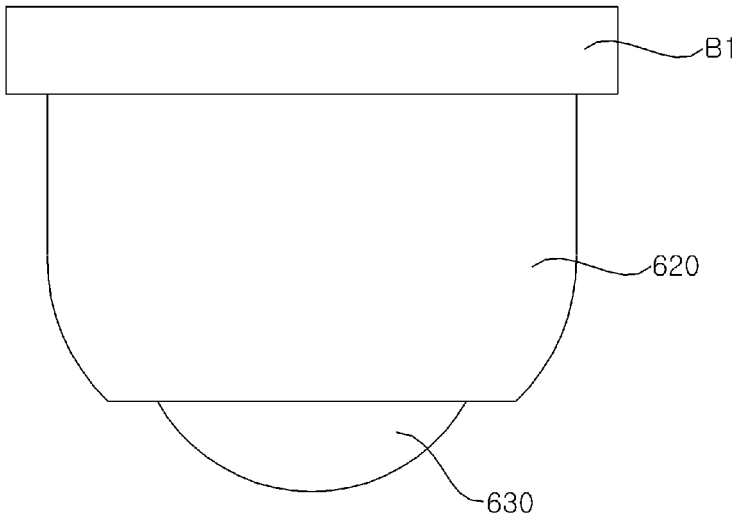
FIG. 5 is a front view of a state sensing unit.
Figure 6A:
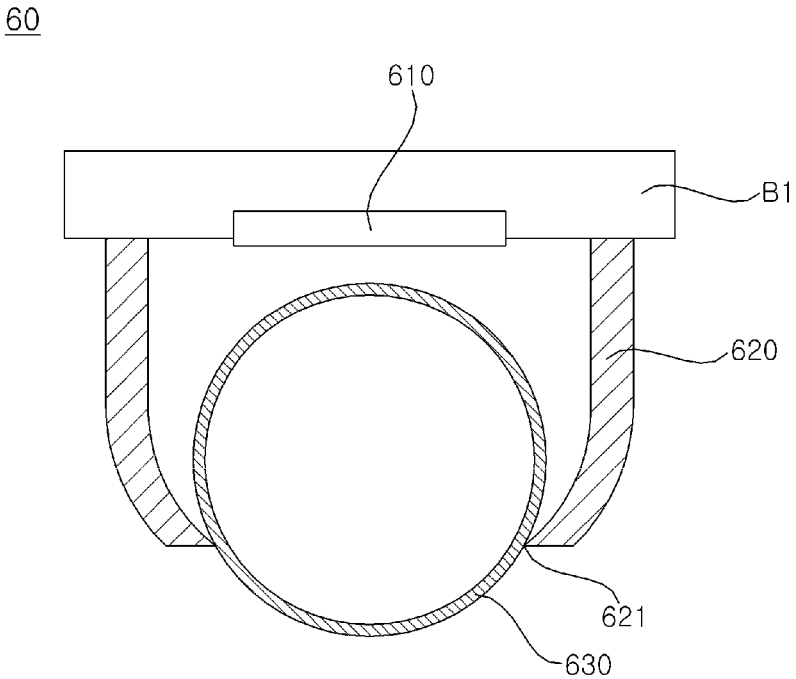
FIG. 6*a* is a sectional view cut vertically near the center of FIG. 5.
Figure 6B:
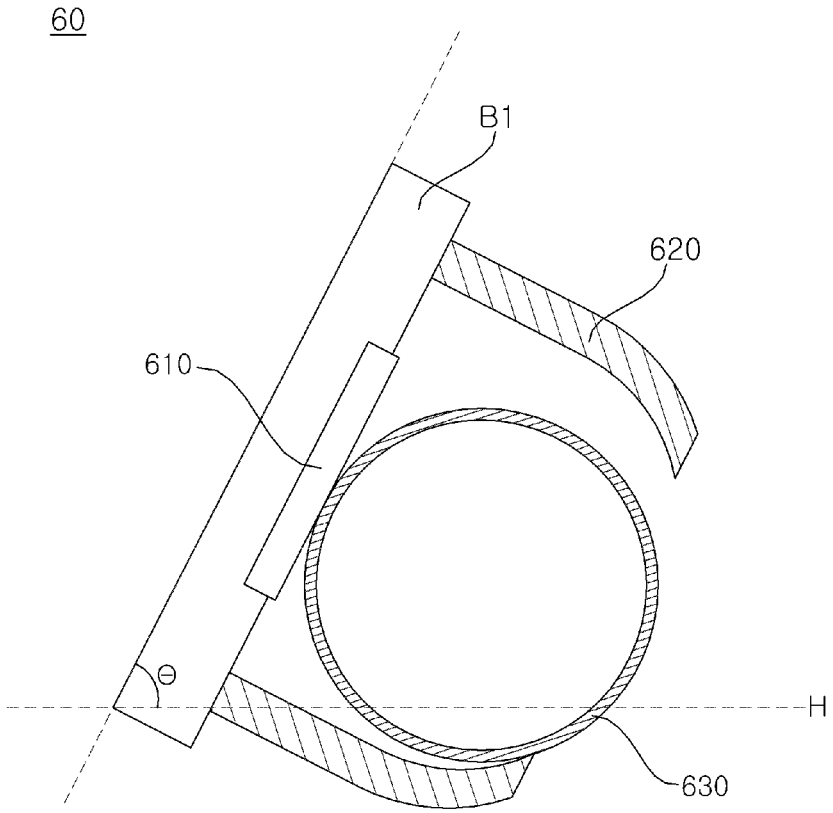
FIG. 6*b* is a view illustrating a tilted state of a state sensing unit.

FIG. 5 is a front view of the state sensing unit 60. FIG. 6*a* is a sectional view cut vertically near the center of FIG. 5. FIG. 6*b* is a view illustrating a tilted state of the state sensing unit 60. Referring to FIGS. 5, 6*a* and 6*b*, the state sensing unit 60 is configured to sense tilt of a predetermined angle or more of the casing C or vibration of a predetermined magnitude or more applied to the casing C. The tilt of the casing C may be generated by external force or damage or deformation of the casing C. The vibration of the casing C may be generated by eccentric rotation or collision with the water tank 4 caused by rotation of the wash tub 6 or the pulsator 9 with an imbalanced laundry load.

The state sensing unit 60 may include a switching conductive element 630 configured to move according to tilt of the casing C or vibration applied to the casing C, a contact electrode 610, and a guide electrode 620 configured to guide movement of the switching conductive element 630 and to be electrically connected to the contact electrode 610 through the switching conductive element 630 when the switching conductive element 630 contacts the contact electrode 610.

Displacement of the switching conductive element 630 may preferably be set such that the switching conductive element 630 comes into contact with the contact electrode 610 when a tilt angle e of the casing C with respect to the horizontal plane H is in the range from 60 to 70 degrees. Regarding vibration, the switching conductive element 630 preferably comes into contact with the contact electrode 610 when vibration generates an acceleration of the switching conductive element of 3G or more.

The switching conductive element 630 may be formed in a substantially spherical shape. Here, the spherical shape may include a solid sphere configured such that a predetermined material fills the switching conductive element 630, and a spherical shell having a cavity therein. The switching conductive element 630 may be made of a stainless steel material, and an outer circumferential surface of the switching conductive element 630 which contacts the contact electrode 610 may be plated with gold for enhanced conductivity.

The guide electrode 620 supports the switching conductive element 630 while keeping contact with the switching conductive element 630. In the state in which the casing C is balanced, the switching conductive element 630 is supported by the guide electrode 620 while spaced apart from the contact electrode 610 (refer to FIG. 6*a*). In the state in which the casing C is tilted by a predetermined angle or more or vibration applied to the casing C has a predetermined magnitude or more, the switching conductive element 630 moves along the guide electrode 620 and comes into contact with the contact electrode 610 (refer to FIG. 6*b*).

The guide electrode 620 may have a substantially ring shape in cross-section. Specifically, an inner periphery of the ring-shaped cross-section may have a substantially circular shape, and a diameter of the circular inner periphery may be gradually reduced toward a lower end of the guide electrode 620 at which the switching conductive element 630 is positioned in a normal state. The guide electrode 620 may have a hole 621 formed at the lower end thereof. The hole 621 has a smaller diameter than the switching conductive element 630 to prevent the switching conductive element 630 from escaping through the hole 621.

A signal processing unit 72 is configured to output a signal related to change of the capacitance of the water level sensing unit 50. The signal output from the signal processing unit 72 indicates change of the water level in the water tank 4, and hereinafter is referred to as a water level change signal. The signal processing unit 72 may include a capacitance-to-digital converter (CDC). The CDC may be operated according to a voltage transmitted thereto from the water level sensing unit 50. When the contact electrode 610 and the guide electrode 620 are electrically connected by movement of the switching conductive element 630, the signal processing unit 72 may output a state sensing signal. The state sensing signal may include a pulse-type trigger signal by short circuit of the CDC.

The signal processing unit 72 may be embodied based on the MEMS technology and may be constructed with temperature sensitive micro elements. Especially, because the CDC may be affected by temperature, it may be preferable for the signal processing unit 72 to generate a water level change signal through a compensation process in which influence of a temperature of the external air is reflected. To this end, the temperature sensing unit 71 for sensing a temperature of the external air may be mounted to the first circuit board B1. The temperature sensing unit 71 outputs a temperature sensing signal according to a temperature of the external air, and the temperature sensing signal is transmitted to the signal processing unit 72.

Figure 7A:
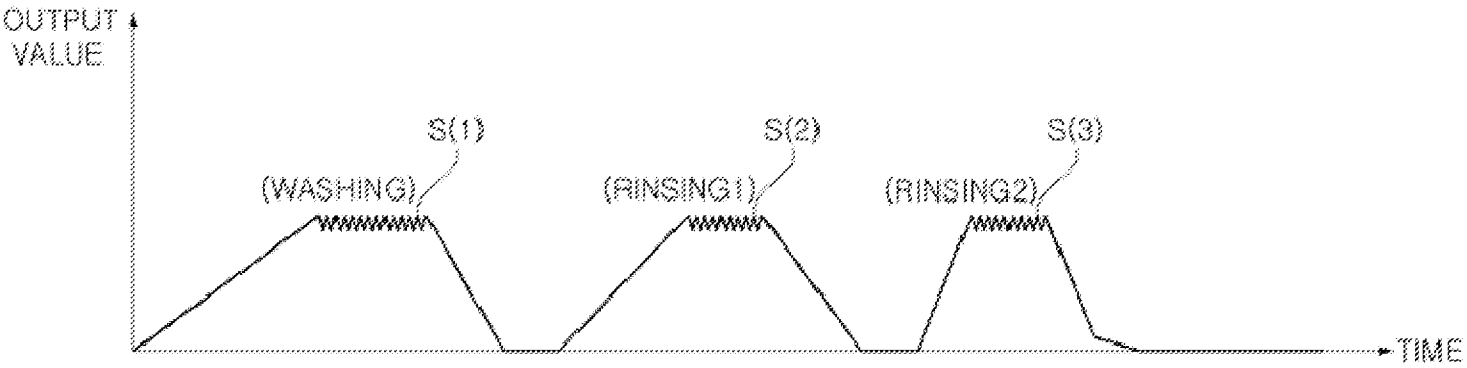
FIG. 7*a* is a view illustrating an output signal from a signal processing unit in a normal state.
Figure 7B:
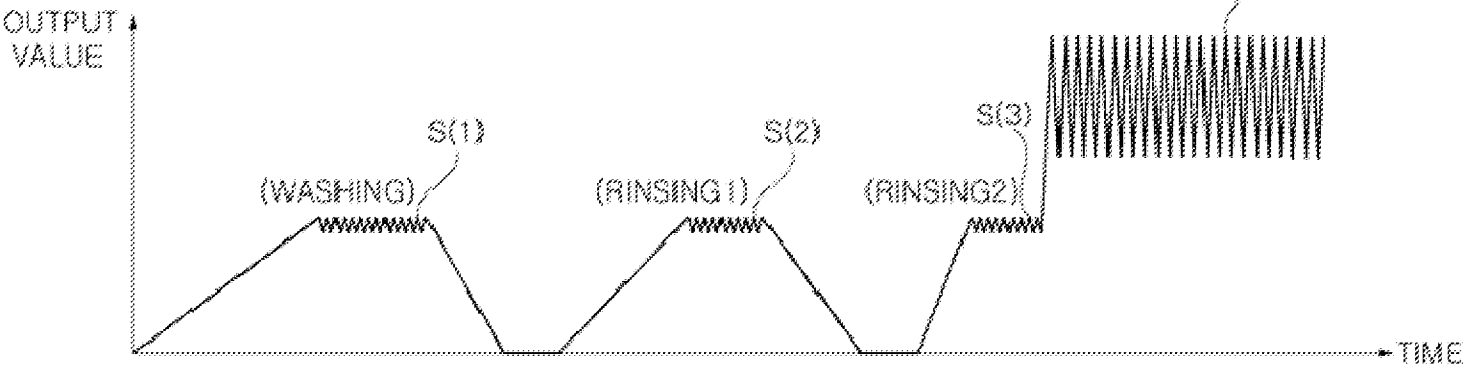
FIG. 7*b* is a view illustrating an output signal from a signal processing unit in a tilted state.

FIG. 7*a* is a view illustrating an output signal from the signal processing unit in a normal state, and FIG. 7*b* is a view illustrating an output signal from the signal processing unit in a tilted state.

Referring to FIGS. 7*a* and 7*b*, the signal processing unit 72 may output a water level change signal and a trigger signal through a common output line. In the state in which the washing machine 1 is operated with vibration having a magnitude less than a predetermined level (hereinafter, referred to as a normal state), because the switching conductive element 630 does not contact the contact electrode 610 in the state sensing unit 60, the signal processing unit 72 outputs only the water level change signal according to change of the capacitance of the water level sensing unit 50. However, when the switching conductive element 630 contacts the contact electrode 610 by tilt or excessive vibration, the signal processing unit 72 outputs the trigger signal.

The common output line may be electrically connected to a control unit 90, and the control unit 90 may control the driving unit 8 to stop operation when receiving the trigger signal. In an exemplary operation in which a washing process, a first rinsing (rinsing 1) process and a secondary rinsing (rinsing 2) process are performed in order, FIG. 7*a* shows signals output through the common output line in a normal state, and FIG. 7*b* shows signals output through the common output line in a tilted state. As shown in the drawing, the water level change signals S(1), S(2) and S(3) having an amplitude within a predetermined range are output in a normal state as shown in FIG. 7*a*. However, the trigger signal T is output in a tilted state in which tilt occurs in the secondary rinsing process as shown in FIG. 7*b*.

The control unit 90 may be mounted to a second circuit board B2 (refer to FIG. 4). The control unit 90 may control not only the driving unit 8 but also the water supply valve 12, the drainage valve 22, the drainage pump 24 and other components. Especially, in the structure in which the first circuit board B1 and the second circuit board B2 are separately provided, since the sensing device 100 and the control unit 90 are physically independent from each other, installation of the sensing device 100 is conveniently achieved without being limited by the position of the control unit 90.

The inventiom claimed is:

1. A washing machine comprising:

a casing (C); and a state sensing unit (60) being configured for sensing tilt of a predetermined angle or more of the casing or vibration of a predetermined magnitude or more applied to the casing, wherein the state sensing unit (60) includes:

a switching conductive element (630) being configured to move according to the tilt or the vibration;

a contact electrode (610); and a guide electrode (620) being configured to guide movement of the switching conductive element (630) and to be electrically connected to the contact electrode (610) through the switching conductive element (630) when the switching conductive element contacts the contact electrode (610) and the guide electrode (620).

2. The washing machine according to claim 1, wherein the guide electrode (620) supports the switching conductive element (630) while keeping contact with the switching conductive element, and guides the switching conductive element such that, when the casing (C) is balanced, the switching conductive element (630) is supported by the guide electrode (620) while spaced apart from the contact electrode (610), and, when the switching conductive element (630) moves by the tilt or the vibration, the switching conductive element (630) comes into contact with the contact electrode (610).

3. The washing machine according to claim 1, wherein the switching conductive element (630) is formed in a spherical shape.

4. The washing machine according to claim 1, wherein the switching conductive element (630) is made of a stainless steel material, and an outer circumferential surface of the switching conductive element to contact the contact electrode (610) is plated with gold.

5. The washing machine according to claim 1, further comprising:

a water tank (4) disposed in the casing (C) to store wash water therein;

a water level sensing unit (50) being configured such that a capacitance is changed according to a water level in the water tank (4); and a signal processing unit (72) being configured to output a water level change signal according to a change of the capacitance, wherein the signal processing unit (72) outputs a state sensing signal when the guide electrode (620) and the contact electrode (610) are electrically connected to each other.

6. The washing machine according to claim 5, wherein the water level change signal and the state sensing signal are output through a common output line.

7. The washing machine according to claim 5, wherein the state sensing signal includes a pulse-type trigger signal.

8. The washing machine according to claim 7, further comprising:

a wash tub (6) rotatably mounted in the water tank (4) to store laundry therein;

a driving unit (8) for rotating the wash tub (6); and a control (7) unit for controlling the driving unit (8) to stop operation according to the trigger signal.

9. The washing machine according to claim 8, further comprising:

a first circuit board (B1) mounted with the water level sensing unit (50) and the state sensing unit (60); and a second circuit board (B2) mounted with the control unit (7).

10. The washing machine according to claim 9, further comprising:

a temperature sensing unit (71) mounted to the first circuit board (B1) to sense a temperature of the external air, wherein the temperature sensing unit (71) outputs a temperature sensing signal to the signal processing unit (72) according to a sensed temperature.

11. The washing machine according to claim 1, wherein the switching conductive element (630) comes into contact with the contact electrode (610) when the casing (C) is slanted by 60 to 70 degrees with respect to a horizontal plane (H).

12. The washing machine according to any of claim 1, wherein the switching conductive element (630) comes into contact with the contact electrode (610) when vibration applied to the casing (C) generates an acceleration of the switching conductive element of 3G or more.

* * * * *